US007618930B2

(12) United States Patent
Diet et al.

(10) Patent No.: US 7,618,930 B2
(45) Date of Patent: Nov. 17, 2009

(54) FOAMING HARD SURFACE CLEANER COMPRISING A TEA ALKYL SULFATE AND AMINE OXIDE SURFACTANT SYSTEM

(75) Inventors: Patrick Diet, Aubin Neufchateau (BE); Isabelle Léonard, Juprelle (BE)

(73) Assignee: Colgate-Palmolive Company, New York, NY (US)

( * ) Notice: Subject to any disclaimer, the term of this patent is extended or adjusted under 35 U.S.C. 154(b) by 21 days.

(21) Appl. No.: 11/561,257

(22) Filed: Nov. 17, 2006

(65) Prior Publication Data

US 2008/0119382 A1 May 22, 2008

(51) Int. Cl.
*C11D 1/83* (2006.01)
*C11D 3/44* (2006.01)

(52) U.S. Cl. ..... 510/180; 510/181; 510/182; 510/238; 510/243; 510/426; 510/427; 510/432

(58) Field of Classification Search ..... 510/180, 510/181, 182, 238, 243, 426, 427, 432
See application file for complete search history.

(56) References Cited

U.S. PATENT DOCUMENTS

| | | | | | |
|---|---|---|---|---|---|
| 3,463,735 | A | | 8/1969 | Stonebraker | |
| 3,819,522 | A | * | 6/1974 | Zmoda et al. | 510/182 |
| 4,302,348 | A | * | 11/1981 | Requejo | 510/429 |
| 4,606,842 | A | * | 8/1986 | Keyes et al. | 510/182 |
| 4,666,621 | A | * | 5/1987 | Clark et al. | 15/104.93 |
| 4,689,168 | A | * | 8/1987 | Requejo | 510/417 |
| 5,252,245 | A | * | 10/1993 | Garabedian et al. | 510/427 |
| 5,254,284 | A | | 10/1993 | Barone et al. | |
| 5,523,024 | A | * | 6/1996 | Garabedian et al. | 510/433 |
| 5,534,198 | A | * | 7/1996 | Masters et al. | 510/182 |
| 5,597,793 | A | | 1/1997 | Besse et al. | |
| 5,705,470 | A | | 1/1998 | Faris | |
| 5,716,921 | A | | 2/1998 | Neumiller | |
| 5,750,482 | A | * | 5/1998 | Cummings | 510/182 |
| 5,795,853 | A | * | 8/1998 | Denis et al. | 510/182 |
| 5,798,324 | A | * | 8/1998 | Svoboda | 510/182 |
| 5,849,681 | A | * | 12/1998 | Neumiller et al. | 510/182 |
| 5,977,050 | A | | 11/1999 | Faris | |
| 6,303,556 | B1 | * | 10/2001 | Kott et al. | 510/357 |
| 6,362,148 | B1 | * | 3/2002 | Durbut et al. | 510/238 |
| 6,420,326 | B1 | | 7/2002 | Maile | |
| 6,565,804 | B1 | | 5/2003 | Conway | |
| 6,680,264 | B2 | * | 1/2004 | Julemont | 442/64 |
| 6,701,940 | B2 | * | 3/2004 | Tsibouklis et al. | 134/25.2 |
| 6,926,745 | B2 | * | 8/2005 | Scheuing et al. | 8/115.51 |
| 2002/0119902 | A1 | * | 8/2002 | Harrison et al. | 510/424 |
| 2004/0116544 | A1 | | 6/2004 | Mercurio | |
| 2004/0154640 | A1 | | 8/2004 | Smith et al. | |
| 2004/0229963 | A1 | * | 11/2004 | Culeron et al. | 516/115 |
| 2005/0003990 | A1 | | 1/2005 | Smith et al. | |
| 2005/0026796 | A1 | * | 2/2005 | Leonard et al. | 510/180 |
| 2005/0085407 | A1 | * | 4/2005 | Oldenhove et al. | 510/504 |
| 2006/0094626 | A1 | | 5/2006 | Horton, III et al. | |
| 2006/0229227 | A1 | * | 10/2006 | Goldman et al. | 510/417 |
| 2007/0117736 | A1 | * | 5/2007 | Figger et al. | 510/421 |

FOREIGN PATENT DOCUMENTS

| | | |
|---|---|---|
| EP | 0 527 625 A2 | 2/1993 |
| EP | 0 883 680 | 4/2003 |
| GB | 2 339 789 A | 2/2000 |

OTHER PUBLICATIONS

International Search Report PCT/US2006/061047 mailed Jul. 31, 2007.

* cited by examiner

*Primary Examiner*—Charles I Boyer
(74) *Attorney, Agent, or Firm*—Michael Morgan

(57) ABSTRACT

A foamable composition comprising: a) at least one anionic surfactant chosen from a salt of an alkyl sulfate and a salt of an alkyl ether sulfate in an amount of about 0.01 to about 1% by weight of the composition; b) at least one glycol ether in an amount of about 0.1 to about 1.5% by weight of the composition; c) at least one alcohol in an amount of about 2 to about 6% by weight of the composition; and d) water. Also, a foamable composition comprising: a) at least one anionic surfactant chosen from a salt of an alkyl sulfate and a salt of an alkyl ether sulfate; b) at least one glycol ether; c) at least one alcohol; and d) water, wherein the composition has a run down time of greater than about 15 seconds on a vertical glass surface across a distance of 10 cm.

16 Claims, No Drawings

FOAMING HARD SURFACE CLEANER COMPRISING A TEA ALKYL SULFATE AND AMINE OXIDE SURFACTANT SYSTEM

BACKGROUND OF THE INVENTION

Hard surface cleaners are usually mostly water that include cleaning materials, fragrance, and color. Hard Surface cleaners are usually sprayed onto a surface and then wiped to clean the surface. Because hard surface cleaners are mostly water, they will drip when applied to vertical surfaces because of gravity.

This requires a person to quickly wipe the surface before the hard surface cleaner drips down the surface to be cleaned. The dripping of the hard surface cleaner does not allow for a longer residence time of the hard surface cleaner on the surface to effect more cleaning. It would be desirable to have a hard surface cleaner that could remain in place when applied to a surface.

BRIEF SUMMARY OF INVENTION

A foamable composition comprising:

a) at least one anionic surfactant chosen from a salt of an alkyl sulfate and a salt of an alkyl ether sulfate in an amount of about 0.01 to about 1% by weight of the composition;

b) at least one glycol ether in an amount of about 0.1 to about 1.5% by weight of the composition;

c) at least one alcohol in an amount of about 2 to about 6% by weight of the composition; and d) water.

A foamable composition comprising:

a) at least one anionic surfactant chosen from a salt of an alkyl sulfate and a salt of an alkyl ether sulfate;

b) at least one glycol ether; and c) at least one alcohol; and d) water, wherein the composition has a run down time of greater than about 15 seconds, wherein the run down time is measured by providing a vertical glass surface, which is perpendicular to the earth's surface, with a first horizontal line that is 10 cm above a second horizontal line and both are parallel to the earth's surface, applying the composition to the vertical glass surface at the first horizontal line from a distance of 20 cm perpendicular to the surface, and measuring the time for the composition to run down from the first horizontal line to the second horizontal line.

DETAILED DESCRIPTION OF INVENTION

As used throughout, ranges are used as a shorthand for describing each and every value that is within the range. Any value within the range can be selected as the terminus of the range.

All references to amounts in this specification are by active weight of the material in the total composition. The active weight of a material is the actual amount of the material not including other materials, such as water, in the form in which it is supplied.

As used throughout, the counter ion for the salt of a surfactant can be a metal ion, an ammonium ion, or an amine. Metal cations that can be used include, but are not limited to, alkali metal ions and alkaline earth ions. In some embodiments, the metal cation ion can be lithium, sodium, potassium, magnesium, or calcium. In some embodiments, the amine is triethanolamine.

The foaming composition includes at least one anionic surfactant chosen from a salt of an alkyl sulfate surfactant and a salt of an alkyl ether sulfate surfactant. In one embodiment, the surfactant is present in the composition in an amount of about 0.01 to about 1% by weight.

In one embodiment, the surfactant comprises a triethanolamine alkyl sulfate. In one embodiment, the alkyl is a C10 to C14 alkyl. In another embodiment the surfactant comprises a triethanolamine lauryl sulfate. In one embodiment, the triethanolamine alkyl sulfate is present in an amount of about 0.1 to about 0.3% by weight, and in another embodiment in an amount of about 0.18 to about 0.22% by weight.

In another embodiment, the surfactant comprises the salt of an alkyl ether sulfate. In one embodiment, the alkyl is a C10 to C14. In one embodiment the surfactant is a sodium lauryl ether sulfate. In one embodiment, there is an average of about 1 to about 10 moles of ethylene oxide per mole. In another embodiment, there is an average of about 2 to about 3 moles of ethylene oxide per mole. In one embodiment, the sodium lauryl ether sulfate is present in an amount of about 0.05 to about 0.2% by weight, and in another embodiment at 0.06 to about 0.08% by weight.

In addition to the anionic surfactant, the foaming composition can include an amine oxide surfactant. Amine oxide semi-polar nonionic surfactants can comprise compounds and mixtures of compounds having the formula:

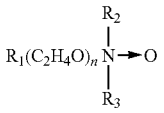

wherein $R_1$ is an alkyl, 2-hydroxyalkyl, 3-hydroxyalkyl, or 3-alkoxy-2-hydroxypropyl radical in which the alkyl and alkoxy, respectively, contain from 8 to 18 carbon atoms, $R_2$ and $R_3$ are each methyl, ethyl, propyl, isopropyl, 2-hydroxyethyl, 2-hydroxypropyl, or 3-hydroxypropyl, and n is from 0 to 10. Particularly preferred are amine oxides of the formula:

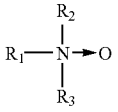

wherein $R_1$ is a $C_{12-16}$ alkyl and $R_2$ and $R_3$ are methyl or ethyl. Examples of the above ethylene oxide condensates, amides, and amine oxides are described in U.S. Pat. No. 4,316,824. In one embodiment the amine oxides comprise alkyl amine oxides and/or cocoamidopropyl amine oxide. In one embodiment, the ratio of anionic surfactant to amine oxide surfactant is about 3:1 to about 4:1.

The composition additionally includes at least one glycol ether. In one embodiment, the amount of glycol ether is about 0.1 to about 1.5% by weight. Examples of glycol ethers include, but are not limited to, propylene glycol n-butyl ether, propylene glycol n-propyl ether, ethylene glycol n-hexal ether, ethylene glycol n-butyl ether, dipropylene glycol methyl ether, and combinations thereof. In one embodiment, the composition includes propylene glycol n-butyl ether in an amount up to about 1.5% by weight, and in another embodiment at about 1.25% by weight.

The foaming composition includes at least one alcohol. Any alcohol can be used in the composition. In one embodiment, the alcohol comprises a $C_1$-$C_6$ alkyl alcohol. In one embodiment, the alcohol is chosen from methanol, ethanol, n-propanol, isopropanol, n-butyl alcohol, sec-butyl alcohol, isobutyl alcohol, tert-butyl alcohol, 1-2- or 3-pentanol, neopentyl alcohol, and/or hexanol. In certain embodiments, the alcohol is present in the composition in an amount of about 2 to about 6% by weight, about 3 to about 5% by weight, about 3 to about 4.5% by weight, or in another embodiment, the amount is about 4% by weight.

In one embodiment, the at least one alcohol comprises ethanol. In another embodiment, ethanol is present in the composition in an amount of about 2 to about 6% by weight, about 3 to about 5% by weight, about 3 to about 4.5% by weight, or in another embodiment, the amount is about 4% by weight. In another embodiment, the alcohol comprises ethanol and isopropanol. In another embodiment, isopropanol is present in an amount of 0 to about 1.5% by weight, and in another embodiment the isopropanol is present at about 1% by weight.

The composition can optionally include at least one dispersant. The dispersant can be present in any amount that provides a dispersant effect. In one embodiment, the dispersant is present in an amount of about 0.01 to about 1% by weight. In one embodiment, the dispersant is a maleic acid/olefin copolymer. In one embodiment, a dispersant of this type is a maleic acid/diisobutylene copolymer available from Rohm and Haas under the trade name ACUSOL™ 460NK.

The composition can additionally include any fragrance or perfume. In one embodiment, the perfume is present in an amount of about 0.03 to about 0.08% by weight. The composition can additionally include any dye or coloring agent. Additionally the composition can contain any pH agent, a biocide/antibacterial agent, or any other material for a desired effect. Also, ammonium hydroxide and/or vinegar can be included, and in one embodiment they can be included up to about 0.2% by weight. In one embodiment, citric acid can be used to adjust the pH of the composition.

Water can be included in the composition in any amount to make the sum of the amount of materials in the composition total 100 weight percent.

The composition when applied as a foam to a vertical glass surface will have a run down time of greater than about 15 seconds. In other embodiments, the run down time is greater than about 18 seconds, greater than about 20 seconds, greater than about 23 seconds, or about 15 to about 30 seconds. Run down time is measured by applying the foamed composition to a vertical glass surface, which is perpendicular to the earth's surface, at a first horizontal line marked on the surface from a distance of 20 cm perpendicular to the surface using a foaming dispenser. A second horizontal line is marked 10 cm below the first horizontal line on the glass surface. Run down time is the time that it takes the composition to run down from the first line to the second line. Both the first and second horizontal lines are parallel to the earth's surface.

In one embodiment, the foam is generated by a foaming dispenser that mixes air with the composition when it is dispensed. In this embodiment, the composition does not contain any propellants that would eject the composition from the container or cause the composition to foam. Any foaming dispenser can be used with the composition. In one embodiment, the dispenser is available from MeadWestvaco Calmar GmbH under the product name TS 800 Top Gun Trigger Sprayer.

The composition can be used as a cleaner on all surfaces. In one embodiment, the surface is a horizontal surface, which is parallel to the earth's surface. In one embodiment, the surface is a non-horizontal surfaces, such as those that are angled at greater than 0 to 90° to the earth's surface. In another embodiment, the composition can be used as a cleaner on a vertical surface, which is perpendicular to the earth's surface. In one embodiment, the composition is a glass cleaner.

The composition can be used in a method for removing soil from a surface comprising applying the composition to the surface and removing the composition. Removing includes, but is not limited to, wiping, squeegeeing, rinsing, and mopping. The surface can be, horizontal, non-horizontal, or vertical.

The invention is further described in the following examples. The examples are merely illustrative and do not in any way limit the scope of the invention as described and claimed.

EXAMPLE 1

The following table illustrates a prophetic example that can be made by mixing the ingredient.

| Material | % by weight |
|---|---|
| Triethanolamine lauryl sulfate | 0.18-0.22 |
| Propylene glycol n-butyl ether | 0.1-1.5 |
| Ethanol | 3-4.5 |
| Minors | 0.1-0.3 |
| Demineralized water | Q.S. |

EXAMPLE 2

The following table illustrates a prophetic example that can be made by mixing the ingredients.

| Material | % by weight |
|---|---|
| Triethanolamine lauryl sulfate | 0.18-0.22 |
| Propylene glycol n-butyl ether | 0.1-1.5 |
| Ethanol | 3-4.5 |
| ACUSOL 460 NK | 0.4 |
| Minors | 0.1-0.3 |
| Demineralized water | Q.S. |

EXAMPLE 3

The following composition according to the invention was prepared by mixing the ingredients. The composition was added to a container with a foaming dispenser.

| Material | % by weight |
|---|---|
| Triethanolamine lauryl sulfate | 0.2 |
| Propylene glycol n-butyl ether | 1.25 |
| Ethanol | 4 |
| 260°BE Ammonium Hydroxide | 0.44 |
| Demineralized water | Q.S. |

The composition was compared against AJAX™ Triple Action Glass Cleaner, which is commercially available in Europe in a conventional glass cleaner spray bottle, in the run down test described above. A positioning device was used to position each container so that they sprayed at the same point on the vertical glass surface. Several runs were conducted, and the results are shown in the table below. Time is in seconds.

| | Inventive | Comparative |
|---|---|---|
| | 23 | 6 |
| | 29 | 7 |
| | 25 | 7 |
| | 29 | 10 |
| | 23 | 9 |
| | 23 | 6 |
| | 23 | 6 |
| | 19 | 8 |
| | 20 | 9 |
| | 22 | 7 |
| Average | 23.6 | 7.5 |

It can be seen from the table that the foamable composition according to the invention was able to stay in place for a longer time as compared to a conventional glass cleaner.

What is claimed is:

1. A foam composition comprising:

a) a surfactant system, which consists essentially of a mixture of a triethanolamine alkyl sulfate and an amine oxide surfactant, in an amount of about 0.01 to about 1% by weight of the composition;

b) at least one glycol ether selected from the group consisting of propylene glycol n-butyl ether, propylene glycol n-propyl ether, ethylene glycol n-hexyl ether, ethylene glycol n-butyl ether, dipropylene glycol methyl ether, and combinations thereof, in an amount of about 0.1 to about 1.5% by weight of the composition;

c) at least one $C_1$-$C_6$ alkyl alcohol in an amount of about 2 to about 6% by weight of the composition; and d) water, wherein the composition has an improved run down time.

2. The composition of claim 1, wherein the glycol ether is propylene glycol n-butyl ether.

3. The composition of claim 1, wherein the alcohol is ethanol.

4. The composition of claim 1, wherein the alcohol comprises ethanol and isopropanol.

5. The composition of claim 1, wherein the ratio of triethanolamine alkyl sulfate to amine oxide surfactant is about 3:1 to about 4:1.

6. The composition of claim 1, wherein the composition further comprises a dispersant.

7. The composition of claim 1, wherein the glycol ether comprises propylene glycol n-butyl ether, and the alcohol comprises ethanol.

8. The composition of claim 1 further comprising a material selected from the group consisting of a pH agent, a fragrance, a perfume, a coloring agent, a dye, a biocide/antibacterial agent, ammonium hydroxide, and vinegar.

9. The composition of claim 1, wherein the run down time is greater than about 20 seconds.

10. An article comprising a container with a dispenser that delivers the foam composition of claim 1.

11. A foam composition comprising:

a) a surfactant system, which consists essentially of a mixture of a triethanolamine alkyl sulfate and an amine oxide surfactant, in an amount of about 0.01 to about 1% by weight of the composition;

b) at least one glycol ether selected from the group consisting of propylene glycol n-butyl ether, propylene glycol n-propyl ether, ethylene glycol n-hexyl ether, ethylene glycol n-butyl ether, dipropylene glycol methyl ether, and combinations thereof, in an amount of about 0.1 to about 1.5% by weight of the composition;

c) at least one $C_1$-$C_6$ alkyl alcohol in an amount of about 2 to about 6% by weight of the composition; and d) a dispersant, wherein the composition has an improved run down time.

12. A method for removing soil from a surface comprising applying the composition of claim 1 to the surface and removing the composition.

13. The method of claim 12, wherein the surface is a vertical surface.

14. A method for removing soil from a surface comprising applying the composition of claim 11 to the surface and removing the composition.

15. The method of claim 14, wherein the surface is a vertical surface.

16. The composition of claim 11, wherein the glycol ether is propylene glycol butyl ether.

* * * * *